US005487659A

United States Patent [19]

Eroglu et al.

[11] Patent Number: 5,487,659

[45] Date of Patent: Jan. 30, 1996

[54] FUEL LANCE FOR LIQUID AND/OR GASEOUS FUELS AND METHOD FOR OPERATION THEREOF

[75] Inventors: Adnan Eroglu, Untersiggenthal, Switzerland; Franz Joos, Weilheim-Bannholz, Germany; Peter Novacek, Gebenstorf; Peter Senior, Mellingen, both of Switzerland

[73] Assignee: ABB Management AG, Baden, Switzerland

[21] Appl. No.: 262,454

[22] Filed: Jun. 20, 1994

[30] Foreign Application Priority Data

Aug. 10, 1993 [DE] Germany ..... 43 26 802.1

[51] Int. Cl.[6] ..... F23D 14/46

[52] U.S. Cl. ..... 431/350; 431/183; 431/2; 431/12

[58] Field of Search ..... 431/350, 183, 431/2, 12, 8; 60/740, 737; 239/405

[56] References Cited

U.S. PATENT DOCUMENTS

| | | | |
|---|---|---|---|
| 1,512,132 | 10/1924 | Pfahl . | |
| 3,215,188 | 11/1965 | Paulencu . | |
| 3,671,172 | 6/1972 | Chedaille et al. . | |
| 3,938,325 | 2/1976 | Bergt | 60/39.72 R |
| 4,229,944 | 10/1980 | Weiler | 60/740 |
| 5,101,633 | 4/1992 | Keller et al. | 60/737 |

FOREIGN PATENT DOCUMENTS 2641605 7/1977 Germany .

OTHER PUBLICATIONS

Air Blast Atomization, Arthur H. Lefebvre, Proced. Energy Combustion Science vol. 6, pp. 233–261, Pergamon Press Ltd 1980.

*Primary Examiner*—Larry Jones

*Attorney, Agent, or Firm*—Burns, Doane, Swecker & Mathis

[57] ABSTRACT

A fuel lance for liquid and/or gaseous fuels for use in a combustion chamber includes a liquid fuel pipe extending along a lance center line and defining a liquid fuel passage, a gas pipe surrounding the liquid fuel pipe and forming therebetween a gas passage, and a lance outer shell surrounding the gas pipe and forming an air passage around the gas pipe for cooling air and atomizer air. At least one air/fuel nozzle is provided in a peripheral side of the lance outer shell at a downstream end of the fuel lance for air flow out of the air passage into the combustion chamber. At least one gas nozzle is provided in the gas pipe for gas flow out of the gas passage into the air passage, the gas nozzle is positioned relative to the air/fuel nozzle so that gas from the gas nozzle flows with air from the air passage through the at least one air/fuel nozzle into the combustion chamber. At least one liquid fuel nozzle is provided in the liquid fuel pipe for liquid fuel flow out of the liquid fuel passage, the liquid fuel nozzle being positioned relative to the gas nozzle and air/fuel nozzle so that liquid fuel from the liquid fuel nozzle flows through the air passage and, with the air, through the air/fuel nozzle into the combustion chamber.

20 Claims, 5 Drawing Sheets

FUEL LANCE FOR LIQUID AND/OR GASEOUS FUELS AND METHOD FOR OPERATION THEREOF

BACKGROUND OF THE INVENTION

1. Field of the Invention

The present invention relates to the field of combustion technology. It concerns a fuel lance for liquid and/or gaseous fuels for use in a combustion chamber, such as is used in gas turbines for example.

2. Discussion of Background

Fuel lances are used for the injection of liquid and/or gaseous fuels into the combustion chamber of a premixing burner and these fuel lances protrude into the combustion chamber and introduce the fuel or fuels in a suitable distribution into the combustion air which is flowing past.

In the design of such fuel lances, various requirements have to be satisfied and these are provided partly by the environmental conditions and partly by the demands made on them:

The combustion air flowing past the fuel lance has a temperature which is substantially independent of the flow of fuel in the lance. It can be necessary to protect the lance itself, and also the fuels carried in it, from an excessively high combustion air temperature.

If the combustion chamber has to be operated with a high fuel quantity ratio between full load and part load, care must be taken to ensure that the fuel is present with a suitable distribution under every operating condition and can be introduced and mixed in the same manner into the flow of combustion air. Because the aerodynamics of the burner are practically independent of the fuel, the attainment of optimum combustion demands that the gaseous fuel and the liquid fuel should be injected in the same manner into the flow of the combustion air.

To keep the efficiency of the burner as high as possible, as little carrier or auxiliary air as possible should be used in the lance.

Furthermore, it is necessary to ensure that, as far as possible, no recirculation zones or wakes, which are filled with gas containing fuel and can lead to flashback or thermo-acoustic vibrations, are formed in the region of the fuel lance.

In the injection of liquid fuel, i.e. oil in particular, it is necessary to avoid the finely divided oil/air mixture igniting prematurely.

In the case of liquid fuels, it is also necessary to avoid the formation of troublesome deposits within the lance owing to increased temperatures and evaporation of the fuel since this could impair the operation of the lance in the long term or make it quite impossible.

SUMMARY OF THE INVENTION

Accordingly, one object of the invention is to provide a novel fuel lance and a method of operating it which satisfy the requirements mentioned above and ensure reliable injection of gaseous and/or liquid fuel with, at the same time, high efficiency and low pollutant emissions.

The object is achieved in a fuel lance for liquid and/or gaseous fuels for use in the combustion chamber of a premixing burner, which fuel lance comprises (a) a liquid fuel pipe extending along a lance center line and surrounding a liquid fuel passage for carrying a liquid fuel;

(b) a gas pipe surrounding the liquid fuel pipe and forming a gas passage between itself and the liquid fuel pipe for carrying a gaseous fuel;

(c) a lance outer shell surrounding the gas pipe and forming an air passage between itself and the gas pipe for carrying cooling air and atomizer air;

(d) at least one air/fuel nozzle which is provided in the side of the lance outer shell at the downstream end of the fuel lance and through which air can flow out of the air passage into the combustion chamber surrounding the fuel lance; whereby (e) arranged in the gas pipe, there is at least one gas nozzle through which gas can flow out of the gas passage through the air passage and, with the air, through the at least one air/fuel nozzle into the combustion chamber; and whereby (f) arranged in the liquid fuel pipe, there is at least one liquid fuel nozzle through which liquid fuel can flow out of the liquid fuel passage through the air passage and, with the air, through the at least one air/fuel nozzle into the combustion chamber.

The core of the invention consists in equipping the lance with a suitable nozzle arrangement and a special cooling air supply which jackets the lance and makes it possible to employ the cooling air simultaneously for cooling the lance and the fuel, for atomizing liquid fuel, for preventing premature ignition and for generally supporting the mixing process. This provides optimum mixing and combustion which lead to a high efficiency with simultaneously low pollutant emissions.

In a first preferred embodiment of the fuel lance according to the invention, the at least one air/fuel nozzle and the at least one gas nozzle are of circular configuration and are arranged one behind the other on a common nozzle center line, and the diameter of the gas nozzle is smaller than the diameter of the air/fuel nozzle. The gas flow emerging from the gas nozzle is, in this manner, jacketed by an airflow when passing through the air/fuel nozzle. On the one hand, this achieves the effect that practically the same injection path is provided for the gaseous fuel as for the liquid fuel. On the other hand, the airflow supports the gas injection substantially independently of the gas quantity so that even in the case of small gas flows, the aerodynamic relationships in the combustion chamber hardly change.

Particularly simple and uniform flow relationships within the lance and at the nozzles are provided for the various fuels if, in accordance with a second preferred embodiment of the invention, the liquid fuel nozzle, together with the two other nozzles, is also arranged on the common nozzle center line, and the diameter of the liquid fuel nozzle is smaller than the diameter of the gas nozzle, and if the liquid fuel pipe and the gas pipe are firmly connected to the lance outer shell in the region of the nozzles. The fixed connection between the inner tubes and the lance outer shell then ensures that the position of the nozzles relative to one another can hardly be displaced even in the case of thermal expansions.

A further preferred embodiment of the invention is one wherein the gas pipe and the liquid fuel pipe end, in the flow direction, before the at least one air/fuel nozzle, wherein the gas nozzle and the liquid fuel nozzle are arranged at the end of the respective pipe and are directed parallel to the lance center line and wherein a vane-shaped guide plate is provided for each air/fuel nozzle and the further nozzles, which guide plate deflects the gas and liquid flows emerging from the further nozzles by approximately 90° and guides them into the respective air/fuel nozzle. By this means, an air-driven atomizer, which is known in the English language literature as a "prefilming atomizer" (on this point, see also A. H. Lefebvre, Airblast Atomization, Prog. Energy Combust. Sci., Vol. 6, pp. 233–261 (1980)), is brought into effect for the distribution and mixing of the liquid fuel.

In a further preferred embodiment of the fuel lance according to the invention, the air passage is led around the downstream end of the fuel lance, and at least one auxiliary nozzle directed substantially parallel to the lance center line is provided in this end, and air can flow out of the air passage through this auxiliary nozzle into the combustion chamber. By means of the auxiliary nozzle, fuel-free air is injected into the space behind the tip of the lance in order to prevent the formation, at this critical location, of wakes and/or recirculation zones containing fuel.

The method according to the invention of operating the fuel lance according to the invention is one wherein air with a temperature of up to several hundred degrees centigrade, but preferably less than 600° C., is carried through the air passage to the air/fuel nozzle in order to cool the lance and distribute the fuel and is there blown into the combustion chamber as a flow jacketing the fuel flow. By this means, reliable cooling of the lance is achieved even where the combustion air or combustion gases flowing past the lance have relatively high temperatures.

Further embodiments of the fuel lance according to the invention and embodiments of the method of operation according to the invention are given in the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
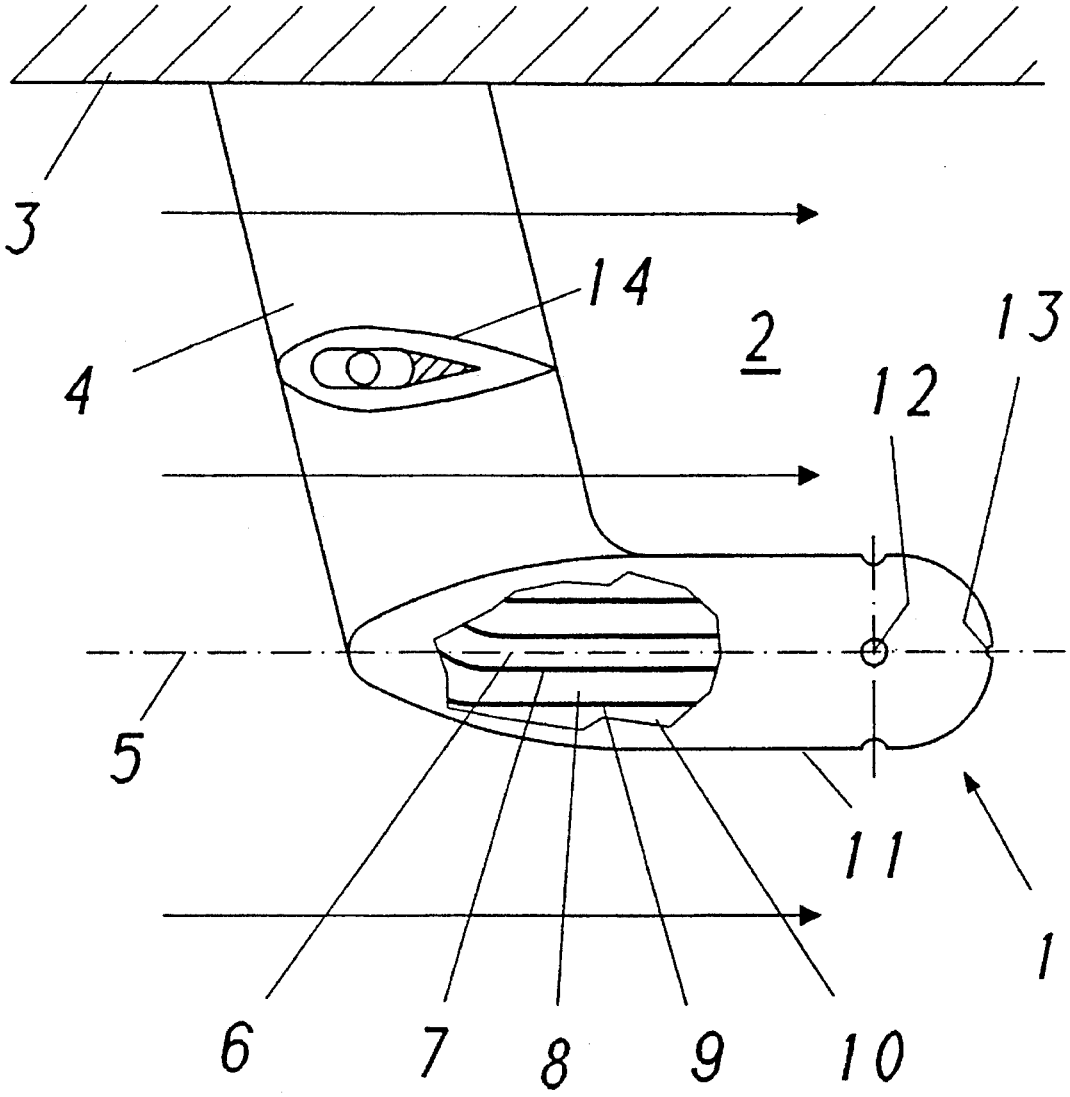
FIG. 1 shows, in side view, a fuel lance according to the invention arranged in a combustion chamber.

Referring now to the drawings, wherein like reference numerals designate identical or corresponding parts throughout the several views, in FIG. 1 a possible arrangement of one example of a fuel lance in accordance with the invention is shown, in side view in a combustion chamber 2, of a gas turbine or the like, bounded by a casing 3 (only a partial excerpt of the chamber is shown). The lance center line 5 of the fuel lance 1 is arranged along the center line of the combustion chamber 2 in this example and (as is indicated by the three long arrows in FIG. 1) it has hot combustion air flowing around it. The fuel lance 1 is therefore matched to the aerodynamic relationships in the combustion chamber 2 and is streamlined. It is surrounded by an elongated lance outer shell 11 and is fastened to the casing 3 by means of a support arm 4 branching off to the side. The support arm 4 is likewise streamlined and can have an aerofoil-type support arm profile 14 in the cross-section drawn.

A plurality of pipes extend through the support arm 4 and through the fuel lance 1 itself—as becomes clear from the opened-up part of the lance shown in FIG. 1. Gaseous and liquid fuel and cooling and atomization air are carried through these pipes to the downstream tip of the lance and are there injected into the combustion chamber 2 through appropriate air/fuel nozzles 12 and an auxiliary nozzle 13, in a manner to be described in more detail later. The pipes include an inner liquid fuel pipe 7 extending in the axial direction and a gas pipe 9 surrounding the liquid fuel pipe 7 concentrically and at a distance. The gas pipe 9 is in turn surrounded concentrically and at a distance by the lance outer shell 11. Three passages, the inner liquid fuel passage 6, the gas passage 8 and the air passage 10, are formed by the concentric arrangement, at a distance from one another, of the pipes and outer shell. Depending on the type of operation of the fuel lance 1, the passages undertake different functions, which are explained in more detail below using three preferred embodiment examples represented in FIGS. 2 to 4.

Figure 2:
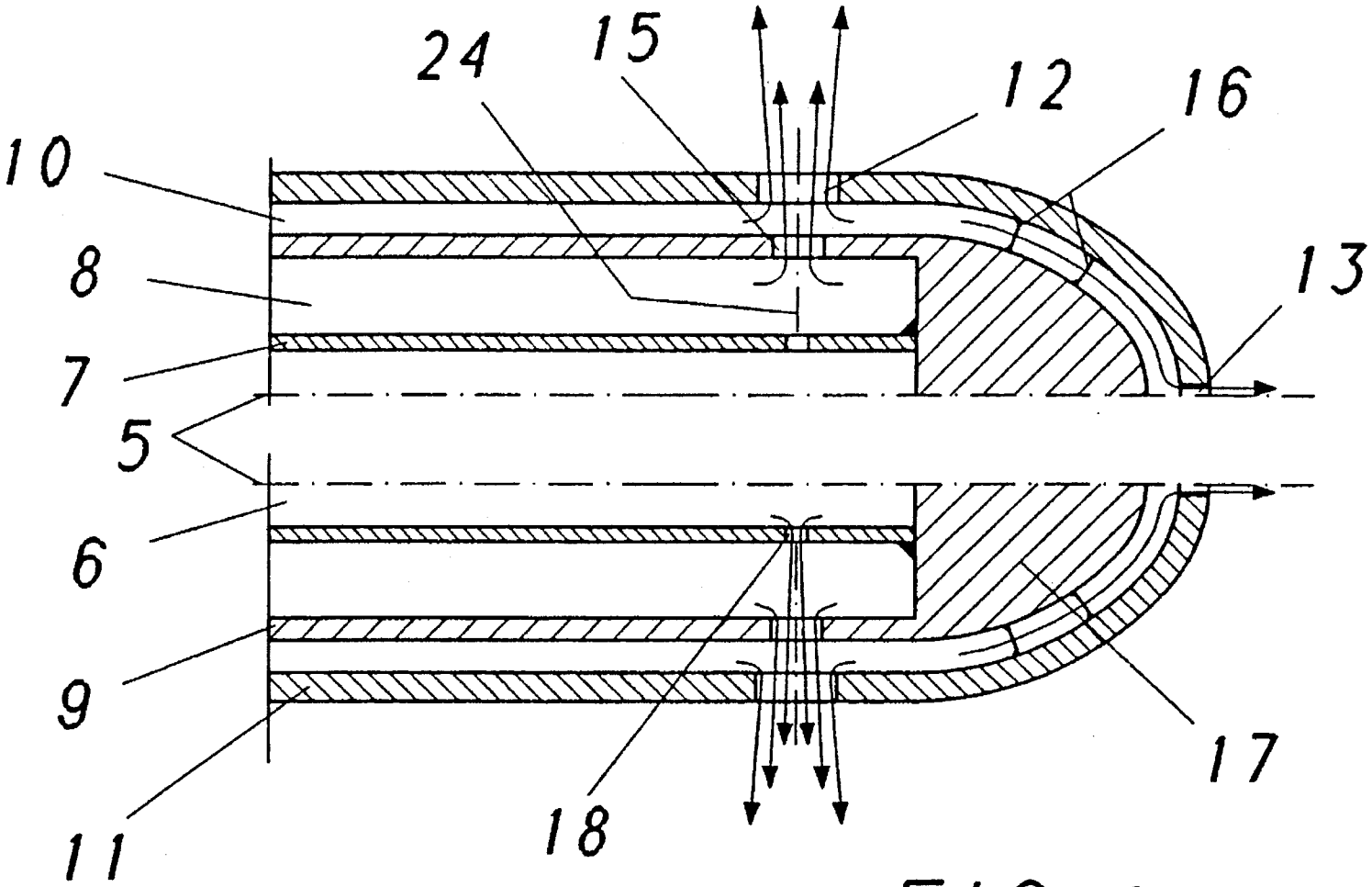
FIG. 2 shows, in longitudinal section, the tip of a first preferred embodiment example of a fuel lance according to the invention with the gas and liquid flows indicated by arrows, operation with gaseous fuel being represented in the upper half and operation with liquid fuel being represented in the lower half.

For the first embodiment example, FIG. 2 shows—in longitudinal section—the lance tip which, for the purpose of explaining different operating cases, is subdivided along the lance center line 5 into two separate halves. With the flows shown (marked by arrows), the upper half relates to the operating case with exclusively gaseous fuel and the lower half relates to the operating case with exclusively liquid fuel. A corresponding representation in two parts has also been selected, for the same reasons, in the case of the other FIGS. 3 and 4.

Coming from the left, the inner liquid fuel pipe 7, the gas pipe 9 and the lance outer shell 11 end at the tip of the lance. At the end, the gas pipe 9 merges into a hemispherical pipe end 17 which closes off the pipe. The liquid fuel pipe 7 is butt-welded (or brazed) to the inner surface of the pipe end 17 and is closed off towards the end by this means. The lance outer shell 11 surrounds the pipe end 17 at a distance in the form of a hemispherical shell so that the air passage 10 formed between the lance outer shell 11 and the gas pipe 9 extends into the immediate lance tip and surrounds the pipe end 17 on the outside. A plurality of connecting webs 16 are welded in—or brazed— between the pipe end 17 and the front hemispherical shell of the lance outer shell 11. In this way, the two pipes 7 and 9 and the lance outer shell 11 form, in the region of the lance tip, a stable, firmly connected unit which prevents displacement of the pipes relative to one another due to thermal expansion.

A plurality of (preferably four) sets of nozzles are provided in the region of the pipe ends and each of these nozzles is arranged along a nozzle center line 24 at right angles (or oblique) to the lance center line 5. The nozzle sets are distributed with respect to number and angular distance apart along the periphery of the fuel lance 1 in such a way as to ensure optimum mixing for a specified secondary pattern of the combustion chamber airflow, while avoiding wakes. Each set of nozzles includes a liquid fuel nozzle 18 let into the liquid fuel pipe 7, a gas nozzle 15 let into the gas pipe and an air/fuel nozzle 12 let into the lance outer shell 11. Each of the nozzles 12, 15 and 18 is preferably circular. Their diameters are stepped, the inner liquid fuel nozzle 18 having the smallest diameter and the outer air/fuel nozzle having the largest diameter. The number and diameter of the liquid fuel nozzles 18 depends on the liquid fuel flow quantity which occurs in the normal case. Attention should be paid to ensuring that the nozzle diameters are not too small so that the nozzles do not become blocked if solid deposits are formed. Otherwise, the number of fuel jets injected into the combustion chamber through the nozzles must not be too large so as not to disturb the aerodynamics around the fuel lance 1 to such an extent that an increased number of wakes containing fuel are formed behind the lance.

In the operating case with pure gas injection shown in the upper half of FIG. 2, the inner liquid fuel passage 6 is not used at all. The combustible gas flows through the gas passage 8 and the gas nozzle 15, where it forms a gas jet which is directed radially outwards and passes through the air/fuel nozzle 12 into the combustion chamber 2. At the same time, cooling air with a temperature up to several hundred degrees centigrade, but preferably less than 600° C., is dispatched through the air passage 10 and likewise emerges radially into the combustion chamber from the air/fuel nozzle where it initially jackets the gas jet. The cooling air has a plurality of functions in this case. On the one hand, it cools the lance outer shell 11 and forms a thermal protective jacket for the fuel passages located further in. On the other hand, it generates a stable air jet at the air/fuel nozzle 12 and this jet remains the same irrespective of how much gas is fed in through the lance so that even in the case of small flow quantities of gaseous fuel, the configuration of the injection jets remains substantially unaltered. Finally, the jacket of relatively cool air permits and supports sufficiently lengthy mixing of the gaseous fuel with the combustion air in the combustion chamber 2. This is necessary for efficient combustion because premature self-ignition of the mixture is reliably avoided.

In the case of the operating case with pure liquid fuel injection shown in the lower half of FIG. 2, a liquid fuel, usually an oil/water emulsion, is carried through the inner liquid fuel passage 6 to the liquid fuel nozzle 18 and is there expelled radially outwards as a liquid jet. In this case, air is introduced through the gas passage 8 and emerges through the gas nozzle 15 where it interacts with the liquid jet likewise passing through the gas nozzle 15 to effect fine atomization of the liquid fuel into small droplets only ("plain-jet airblast atomization"). The atomization jet is then surrounded by a cooling air jacket (which also contributes to the atomization) at the air/fuel nozzle 12 in the same manner as described above and is finally injected into the combustion chamber 2. In addition to the cooling by the air flowing in the air passage 10, a further thermal screening stage is made available by the auxiliary air in the gas passage 8. By this means, the liquid fuel in the liquid fuel passage 6 can be kept at temperatures at which solid deposits are reliably avoided.

As may be seen from the above considerations, the cooling or auxiliary air in the lance according to the invention has several simultaneous functions:

(i) It cools the lance and protects the fuel passages within it from excessive temperatures.

(ii) It cools the fuel jets when they are injected and therefore delays their heating so that adequate mixing with the combustion air can take place before self-ignition.

(iii) It effects, as auxiliary air, the necessary atomization of a liquid fuel.

(iv) On emergence through the air/fuel nozzles 12, it supports—as a jacket flow—the mixing of the fuel jet in the combustion chamber.

(v) Even in the case of small fuel flows, it maintains the jet system emerging from the nozzle sets.

In all these processes, the special arrangement of the nozzles 12, 15 and 18 achieves the effect that whether gaseous or liquid fuel is used, the same aerodynamic configuration always appears, i.e. the fuel jets are injected into the combustion chamber 2 in the same manner. Because of the strong connection between the pipes 7, 9 and to the lance outer shell 11, the single-axis arrangement of the nozzle sets, and therefore the aerodynamic configuration, is maintained even if thermal stresses are present in the lance due to different temperature distributions.

The air from the air passage 10 can, advantageously, undertake a further function. For aerodynamic reasons, wakes—which fundamentally contain fuel and which lead to flash-back or thermo-acoustic vibrations (pulsation)—can form in the flow direction behind the lance tip. Such phenomena cannot be tolerated because they place loads on the combustion chamber and, more particularly, lead to increased pollutant emissions. In order to prevent them, an auxiliary nozzle 13 is preferably provided at the lance tip arranged centrally along the lance center line 5 and through it a fuel-free airflow is injected from the air passage 10 into the part of the combustion chamber located behind the tip. This measure has the simultaneous effect that the fuel lance 1 is cooled right up to the tip.

Figure 3A:
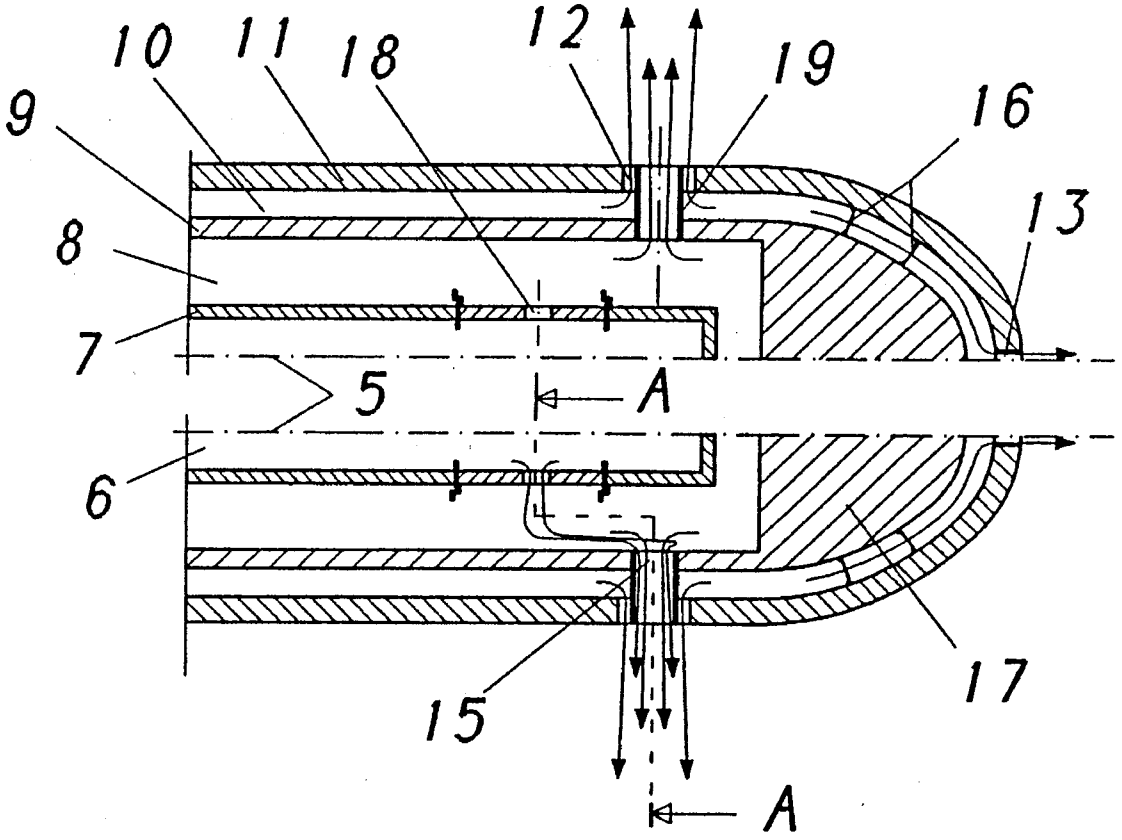
FIG. 3 shows, in longitudinal section (FIG. 3A) and in partial cross-section (FIG. 3B), a second preferred embodiment example, analogous to that of FIG. 2, in the two modes of operation.
Figure 3B:
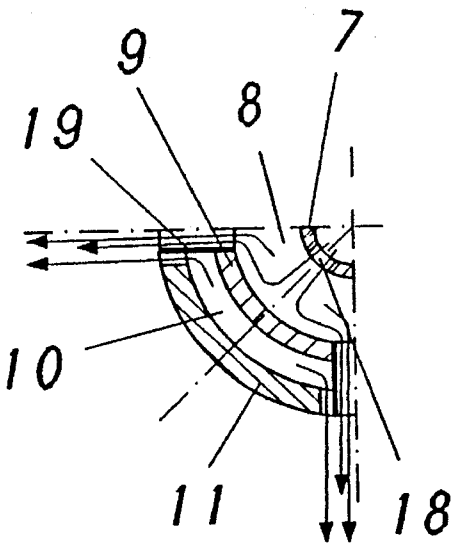

A further preferred embodiment example of a fuel lance according to the invention is shown in FIG. 3. In this representation, FIG. 3A corresponds in the direction of the view to FIG. 2; FIG. 3B is a partial cross-section through the lance along the line A—A of FIG. 3A, the region with the liquid fuel nozzles 18 being shown rotated about the lance center line 5 in FIG. 3A. The embodiment shown departs from that of FIG. 2 principally with respect to the arrangement of the liquid fuel nozzles 18. In this case, the nozzles 18 are no longer arranged, together with the other nozzles 12 and 15, on a common nozzle center line 24 but are displaced rearwards away from the lance tip and are simultaneously rotated about the lance center line 5 (FIG. 3B) so that a jet emerging from them no longer passes to the outside directly through the two other nozzles 15, 12. Because a rigid location of the liquid fuel nozzles 18 relative to the other air/fuel nozzles 12, 15 is no longer necessary in this case, the liquid fuel pipe 7 can end before the pipe end 17 and does not need to be fastened to the pipe end 17. FIG. 2 arises because a guide pipe 19 is fitted into each of the gas nozzles 15. This guide pipe 19 extends from the gas nozzle 15 through the air passage 10 and into the associated air/fuel nozzle 12. This supports the formation of the jacket flow already described above so that a gas flow through the guide pipe 19 reaches the combustion chamber 2 in a relatively protected manner when it emerges from the air/fuel nozzle 12.

As in FIG. 2, the upper part of the illustration in FIG. 3A represents the operating case with gaseous fuel, the liquid fuel pipe 7 being empty and unused. In this case, the formation of the injection jet takes place in a manner completely analogous to that of FIG. 2. The lower part of the illustration shows the operating case with liquid fuel. The liquid fuel emerges as a jet from the liquid fuel nozzle 18, is carried—by the auxiliary air introduced in the gas passage 8—along the inner wall of the gas pipe 9 to the gas nozzle 15 and is there blown out, together with the auxiliary air, through the guide pipe 19, atomization taking place at the same time ("air assist atomizer"). Additional ring plates 20 on both sides of the liquid fuel nozzles 18 improve the flow relationships.

Figure 4A:
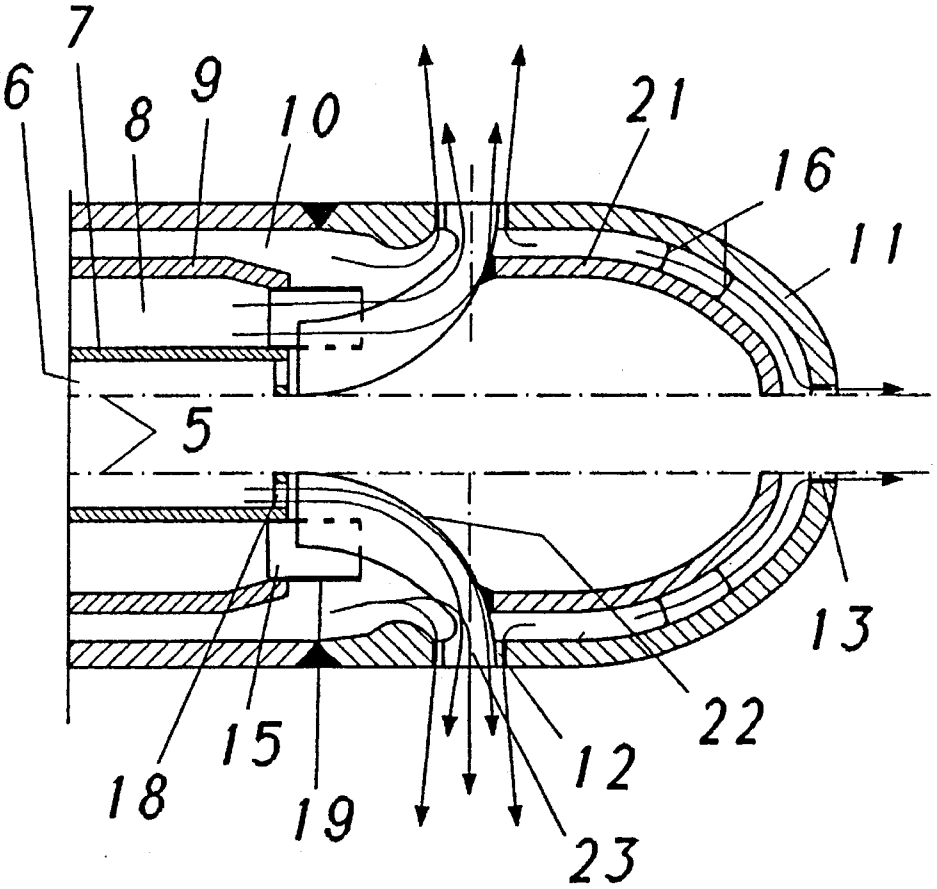
FIG. 4 shows, in longitudinal section (FIG. 4A) and with separate representation of the guide plates (FIG. 4B), a third preferred embodiment example, analogous to FIG. 2, in the two modes of operation.
Figure 4B:
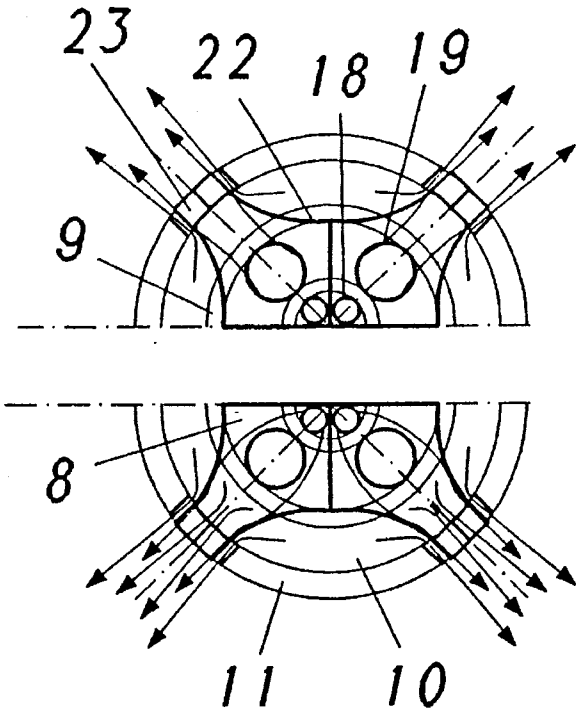

A further preferred embodiment example of a fuel lance in accordance with the invention is shown in FIG. 4. FIG. 4A again corresponds in the direction of the view to FIG. 2 and FIG. 3A whereas the special shape of the guide plates used and their interaction with the nozzles are shown in FIG. 4B in a view in the flow direction. In the embodiment example of FIG. 4, the air/fuel nozzles 12 are arranged at the same location as in the embodiment examples of FIGS. 2 and 3. The arrangement of the other nozzles, however, is clearly different. The gas pipe 9 and the liquid fuel pipe 7 end, in the flow direction, before the air/fuel nozzles 12. The gas nozzle 15 and the liquid fuel nozzle 18 associated with each air/fuel nozzle 12 are located at the end of the respective pipe (9 or 7) and are directed parallel to the lance center line 5. A vane-shaped guide plate 22 is provided for each air/fuel nozzle 12 and the associated nozzles 15, 18; this guide plate 22 deflects the gas and liquid flows emerging from the associated nozzles 15, 18 by approximately 90° and introduces them into the respective air/fuel nozzle 12. As may be recognized from FIG. 4B, the guide plates 22 are arranged like a clover leaf around the lance center line 5.

Preferably in the region of the air/fuel nozzle 12, each guide plate 22 ends in a closed sheet-metal ring 23 whose diameter is smaller than the diameter of the air/fuel nozzle 12. By this means, the deflected flows from the associated nozzles 15, 18 are again jacketed by an airflow on emergence from the air/fuel nozzle 12. A guide pipe 19 can be additionally fitted into each of the gas nozzles 15 in order to ensure reliable deflection of the gas flows by the guide plates 22. The guide plates 22 are firmly connected to the lance outer shell 11 in the region of the nozzles (12, 15, 18) so that they cannot be displaced relative to the air/fuel nozzle 12. The connection takes place by means of a pipe end 21 in the form of a hemispherical shell which takes up the position of the pipe end 17 from FIG. 2 and FIG. 3 and is anchored to the lance outer shell 11 by means of the connecting webs 16 already mentioned.

The upper part of the illustration of FIG. 4 again represents pure gas operation in which the liquid fuel pipe 7 is not used. In this case, the gas flow emerges from the gas passage 8 through the guide pipe 19, is deflected by the guide plate 22, is concentrated by the sheet-metal ring 23 and is expelled, jacketed by an airflow, through the air/fuel nozzle 12 into the combustion chamber. In the case of liquid fuel operation in the lower part of the illustration, the gas passage 8 is not, in this case, used. The jet emerging from the liquid fuel nozzle 18 is guided without auxiliary air, as a liquid film on the inner wall of the guide plate 22, to the air/fuel nozzle 12 and is there atomized by very fine droplets being torn away at the outer edge of the sheet-metal ring ("prefilmer atomizer").

Figure 5:
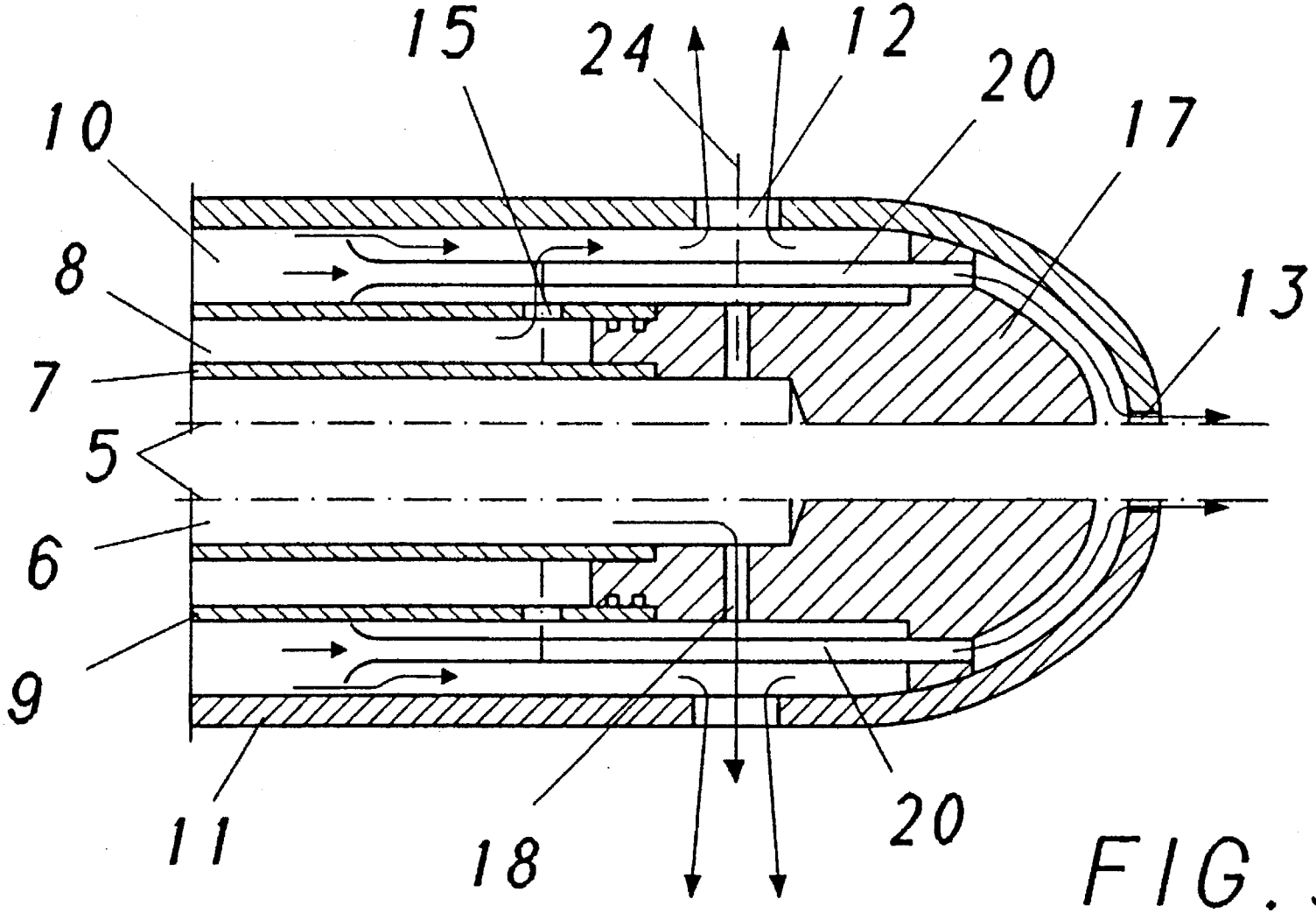
FIG. 5 shows an embodiment example comparable with that of FIG. 2 in which, in the flow direction, the gas nozzles are arranged before the other nozzles.

Another preferred embodiment example of a fuel lance in accordance with the invention is shown in FIG. 5. In this example, only the liquid fuel nozzles 18 and the corresponding air/fuel nozzles 12 are arranged along a nozzle center line 24. Independently of this, the gas nozzles 15 are placed in the flow direction before the other nozzles 12, 18. In the case of gas operation (upper half of the figure), the gas has already been intensively mixed with the cooling air in the air passage 10 before the air/fuel nozzle 12. The gas/air mixture then emerges through the air/fuel nozzle 12 into the combustion chamber. An air pipe 20, which starts before the gas nozzle 15 and leads past the gas nozzle, carries fuel-free cooling air into the end region of the lance where it is injected into the combustion chamber through the auxiliary nozzle 13 in order to prevent wakes. In the case of liquid fuel operation (illustration in the lower part of FIG. 5), the liquid fuel flows out of the liquid fuel nozzle 18 accommodated in the pipe end 17, past the air pipe 20 and directly into the air/fuel nozzle 12 where it interacts with the cooling air from the air passage 10 in the manner already described.

Overall, the invention provides a fuel lance which can inject gaseous and liquid fuels in the same aerodynamic configuration, operates reliably even at high combustion gas temperatures, permits optimum atomization of liquid fuels and makes very low pollutant emissions possible by means of a lengthened mixing process.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel lance for liquid and/or gaseous fuels for use in a combustion chamber, which fuel lance comprises:

(a) a liquid fuel pipe extending along a lance center line and surrounding a liquid fuel passage for carrying a liquid fuel;

(b) a gas pipe surrounding the liquid fuel pipe and forming therebetween a gas passage for carrying a gaseous fuel;

(c) a lance outer shell surrounding the gas pipe and forming an air passage around the gas pipe for carrying cooling air and atomizer air;

(d) at least one air/fuel nozzle provided in a side of the lance outer shell at a downstream end of the fuel lance for air flow out of the air passage into the combustion chamber surrounding the fuel lance;

(e) at least one gas nozzle provided in the gas pipe for gas flow out of the gas passage into the air passage, wherein the at least one gas nozzle is positioned relative to the at least one air/fuel nozzle so that gas from the gas nozzle flows with air from the air passage through the at least one air/fuel nozzle into the combustion chamber; and (f) at least one liquid fuel nozzle provided in the liquid fuel pipe for liquid fuel flow out of the liquid fuel passage the at least one liquid fuel nozzle being positioned relative to the at least one gas nozzle and at least one air/fuel nozzle so that liquid fuel from the liquid fuel nozzle flows through the air passage and, with the air, through the at least one air/fuel nozzle into the combustion chamber.

2. The fuel lance as claimed in claim 1, wherein the at least one air/fuel nozzle and the at least one gas nozzle are of circular configuration and are positioned on a common nozzle center line, and wherein a diameter of the gas nozzle is smaller than a diameter of the air/fuel nozzle.

3. The fuel lance as claimed in claim 2, further comprising a guide pipe extending from the gas nozzle through the air passage into the air/fuel nozzle, an airflow passage from the air/fuel nozzle surrounding the guide pipe.

4. The fuel lance as claimed in claim 2, wherein the liquid fuel nozzle is positioned on the common nozzle center line, and a diameter of the liquid fuel nozzle is smaller than the diameter of the gas nozzle.

5. The fuel lance as claimed in claim 4, wherein the liquid fuel pipe and the gas pipe are firmly connected to the lance outer shell in the region of the nozzles.

6. The fuel lance as claimed in claim 2, wherein the liquid fuel nozzle is positioned relative to the gas nozzle out of the nozzle center line, and the gas pipe is firmly connected to the lance outer shell in the region of the nozzles.

7. The fuel lance as claimed in claim 5, wherein, at a downstream end of the fuel lance, the gas pipe merges into a rounded, closed pipe end which is surrounded by the air passage and the lance outer shell and is fastened to the lance outer shell by a plurality of connecting webs which cross the air passage.

8. The fuel lance as claimed in claim 1, wherein the gas pipe and the liquid fuel pipe end, in a flow direction, before the at least one air/fuel nozzle, wherein the gas nozzle is positioned at the end of the gas pipe and the liquid fuel nozzle is positioned at the end of the liquid fuel pipe and the gas nozzle and liquid fuel nozzle are directed parallel to the lance center line and wherein a vane-shaped guide plate is provided for the at least one air/fuel nozzle, the guide plate positioned for deflecting gas and liquid flows emerging from the gas and liquid fuel nozzles by approximately 90° and the gas and liquid flows into the air/fuel nozzle.

9. The fuel lance as claimed in claim 8, wherein, in the region of the air/fuel nozzle, the guide plate ends in a closed sheet-metal ring whose diameter is smaller than the diameter of the air/fuel nozzle so that the deflected gas and liquid fuel flows are jacketed by an airflow on emergence from the air/fuel nozzle.

10. The fuel lance as claimed in claim 8, wherein a guide pipe is fitted into the gas nozzle and wherein the guide plate is firmly connected to the lance outer shell in the region of the at least one air/fuel nozzle.

11. The fuel lance as claimed in claim 1, wherein a plurality of fuel/air nozzles is distributed over a periphery of the fuel lance.

12. The fuel lance as claimed in claim 1, wherein the lance outer shell and air passage extend along the lance centerline to form a downstream end of the fuel lance, and at least one auxiliary nozzle directed substantially parallel to the lance center line is provided in the lance outer shell at the downstream end for flow out of the air passage through the auxiliary nozzle into the combustion chamber.

13. The fuel lance as claimed in claim 1, wherein the fuel lance is fastened on a casing surrounding the combustion chamber by a side support arm having a streamlined profile and wherein the liquid fuel and gas pipes extend through the support arm to the fuel lance.

14. The fuel lance as claimed in claim 1, wherein, in the flow direction, the at least one gas nozzle is positioned upstream of the air/fuel nozzle and liquid fuel nozzle.

15. The fuel lance as claimed in claim 14, wherein the lance outer shell has at least one auxiliary nozzle directed substantially parallel to the lance center line at the downstream end of the fuel lance for air flow out of the air passage into the combustion chamber and wherein air pipes are disposed in the air passage to guide fuel-free cooling air past the gas nozzle to the auxiliary nozzle.

16. A method of operating a fuel lance, including a liquid fuel pipe extending along a lance center line and defining a liquid fuel passage and having at least one liquid fuel nozzle for liquid fuel flow out of the liquid fuel passage, a gas pipe surrounding the liquid fuel pipe and forming therebetween a gas passage and having at least one gas nozzle for gas flow out of the gas passage into the air passage, and a lance outer shell Surrounding the gas pipe and forming an air passage around the gas pipe for cooling air and atomizer air and having at least one air/fuel nozzle in a peripheral side of the lance outer shell at a downstream end of the fuel lance for air flow out of the air passage into the combustion chamber, wherein the gas nozzle is positioned relative to the air/fuel nozzle so that gas from the gas nozzle flows with air from the air passage through the at least one air/fuel nozzle into the combustion chamber and the liquid fuel nozzle is positioned relative to the gas nozzle and air/fuel nozzle so that liquid fuel from the liquid fuel nozzle flows through the air passage and with the air, through the air/fuel nozzle into the combustion chamber the method comprising the steps of:

directing air through the air passage to the air/fuel nozzle to cool the fuel lance and distribute fuel and wherein the air is blown through the air/fuel nozzle into the combustion chamber as a flow jacketing the fuel flow.

17. The method as claimed in claim 16, wherein gas fuel is directed through the gas passage and the gas nozzle to the air/fuel nozzle and mixes the airflow, wherein the liquid fuel passage remains unused.

18. The method as claimed in claim 16, wherein liquid fuel is directed through the liquid fuel passage and the liquid fuel nozzle to the air/fuel nozzle and mixes with the airflow and wherein air is directed through the gas passage to the air/fuel nozzle to provide distribution and additional cooling of the liquid fuel.

19. The method as claimed in claim 16, wherein the air has a temperature of not more than 600° C.

20. The method as claimed in claim 18, wherein the liquid fuel is in the form of an emulsion.

* * * * *